US008465800B2

(12) United States Patent
Sasaki et al.

(10) Patent No.: US 8,465,800 B2
(45) Date of Patent: Jun. 18, 2013

(54) LEATHER-LIKE SHEET AND PROCESS FOR THE PRODUCTION THEREOF

(75) Inventors: Kunihiko Sasaki, Ooda (JP); Toshihiko Sakamoto, Ooda (JP)

(73) Assignee: Teijin Cordley Limited, Shimane (JP)

( * ) Notice: Subject to any disclaimer, the term of this patent is extended or adjusted under 35 U.S.C. 154(b) by 265 days.

(21) Appl. No.: 12/919,411

(22) PCT Filed: Feb. 26, 2008

(86) PCT No.: PCT/JP2008/053726

§ 371 (c)(1),
(2), (4) Date: Aug. 25, 2010

(87) PCT Pub. No.: WO2009/107246

PCT Pub. Date: Sep. 3, 2009

(65) Prior Publication Data

US 2011/0008575 A1 Jan. 13, 2011

(51) Int. Cl.
*B05D 3/10* (2006.01)

(52) U.S. Cl.
USPC ..... 427/243; 427/244; 427/245; 427/246; 427/337; 427/340; 427/341; 427/342

(58) Field of Classification Search
None
See application file for complete search history.

(56) References Cited

U.S. PATENT DOCUMENTS 6,025,068 A * 2/2000 Pekala ..... 428/315.5
6,451,716 B1 * 9/2002 Sasaki et al. ..... 442/77

FOREIGN PATENT DOCUMENTS

| | | | |
|---|---|---|---|
| EP | 0 904 950 | A1 | 3/1999 |
| JP | 6-264370 | A | 9/1994 |
| JP | 6-264371 | A | 9/1994 |
| JP | 9-59700 | A | 3/1997 |
| JP | 11-036180 | A | 2/1999 |
| JP | 11-043869 | A | 2/1999 |
| JP | 11-158782 | A | 6/1999 |
| JP | 2003-336179 | A | 11/2003 |
| JP | 2005-248388 | A | 9/2005 |
| JP | 2006-104592 | A | 4/2006 |

OTHER PUBLICATIONS

Partial machine translation of JP 11-036180, Feb. 1999.*
Partial machine translation of JP 06-264371, Sep. 1994.*
El-Shishtawy, R. M., et al: "Cationic Pretreatment of Cotton Fabric for Anionic Dye and Pigment Printing with Better Fastness Properties", Coloration Technology, Society of Dyers & Colourists, Bradford, GB, vol. 118, No. 3, Jan. 1, 2002, pp. 115-120, XP001200568, ISSN: 1472-3581.
Extended European Search Report dated Apr. 3, 2012 issued in corresponding European Patent Application No. 08721146.2.

* cited by examiner

*Primary Examiner* — Erma Cameron
(74) *Attorney, Agent, or Firm* — Sughrue Mion, PLLC

(57) ABSTRACT

The invention is to provide a leather-like sheet having a fine image drawn by an inkjet printing method, etc., on its surface and having practically sufficient physical properties. This invention includes a leather-like sheet including (i) a fibrous substrate and (ii) a porous layer thereon, the porous layer having a surface having open pores with a diameter of 1 μm or more and the porous layer having the surface having an image whose definition is 5 dots/mm or more, and a process for the production thereof.

4 Claims, 1 Drawing Sheet

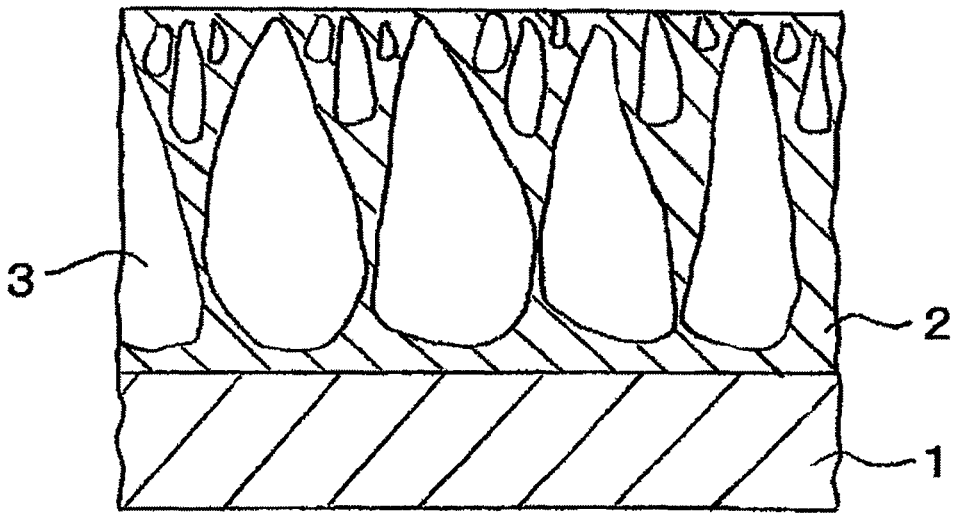
3
2
1

LEATHER-LIKE SHEET AND PROCESS FOR THE PRODUCTION THEREOF

CROSS REFERENCE TO RELATED APPLICATION

This application is a national stage of PCT/JP2008/053726 filed Feb. 26, 2008.

TECHNICAL FIELD

This invention relates to a leather-like sheet having a fine image on its surface. More specifically, it relates to a leather-like sheet having a sharp image and having excellent properties and a process for the production thereof.

BACKGROUND ART

Conventionally, leather-like sheets have been used in various fields, and above all, so-called grained artificial leathers having a elastic polymer layer on the surfaces have been contrived with regard to the expression of their appearances. As a method for the appearance expression, there is employed a method of applying a colored pattern to a sheet surface by known printing techniques such as gravure printing, roller printing, etc., a method of applying a colored pattern by transfer or a method of applying a colored pattern by textile printing.

These patterns are expressed on sheet surfaces by means of patterns of a gravure roll, an engraved roll, a printing screen, etc., and for changing color tones and designed patterns, it is required to repeat the engraving of a pattern on the roll and, further, color matching. In these conventional methods, further, the expression scope and color tone of patterns have limitations such as coloring of one color at one step, etc., and the application of a number of fine patterns to a sheet surface have necessitated a large cost and a long time.

In the field of printing, the technique of multi-color printing of an information pattern drawn on a computer screen for a short period of time with an inkjet printer has come to be widely used in recent years. This inkjet printing method has a characteristic feature in that various patterns can be sharply printed in various colors for a short period of time, differing from the above gravure printing, roller printing, transfer or textile printing according to conventional methods. However, printing on a leather-like sheet is not easy unlike printing on paper, and the present situation is that various attempts are being made.

For example, Patent document 1 describes a leather product having an image drawn by forming an aqueous undercoating agent layer on the surface of leather such as natural leather, providing thereon a finely porous ink receptor layer containing an alumina hydrate and inkjet-printing the image on the finely porous ink receptor layer. However, pores in this leather product are pores of an nm order relying on the alumina hydrate. In this leather product, the ink receiving capacity (dyeing property) of the finely porous ink receptor layer is not sufficient. Even if this method is applied to an artificial leather surface, a sharp pattern is hard to form, and the color tone of the pattern is liable to lack depth. In this method, further, alumina hydrate is liable to frictionally fall off, and in view of abrasion resistance, the above leather product has no practical utility that can be applied to artificial leather that is processed into sport shoes, and the like.

Further, Patent document 2 proposes a process for the production of a leather-like sheet, which comprises drawing an image on an easily dyeable layer on a fibrous substrate with a dye ink according to an inkjet printing method and providing a transparent or semi-transparent protective layer on the drawn image. However, this leather-like sheet uses a dye ink and hence has the following defect. When it is processed into shoes, athletic balls or bags which are in particular used outdoors, and when they are actually used, they are not sufficient in light-resistant fastness, and a fine and sharp image obtained by the inkjet printing method cannot be maintained for a long time.

Due to the use of a dye, further, it has a defect that the resistance to color migration is not sufficient. That is, when the surface of a shoe, ball, bag, glove, or the like, which are processed from the leather-like sheet, comes in contact with the surface of a counterpart, the dye migrates to the surface and stains the counterpart that has contacted.

For overcoming the above problem, it is thinkable to use not a dye ink but a pigment ink as a colorant. That is, when a pigment ink was applied to the inkjet printing method, an image can be maintained for a long time even if it is used outdoors. When a pigment ink is used, however, there are defects that the abrasion resistance, anti-peeling property and flexibility of a surface are degraded. That is, when a pattern is formed on a leather surface with a pigment ink, the defect is that the adhesion strength between a layer on which the pattern is formed and a layer adjacent thereto is greatly decreased due to pigment particles that hamper the adhesion. When the leather-like sheet is processed and shaped into shoes, bags, etc., there is caused a problem that a flexed portion undergoes a peeling off or that an image on a flexed portion falls off.

As described above, leather-like sheets having fine images on their surfaces still have room for improvements with regard to abrasion resistance, light-resistant fastness, resistance to color migration, abrasion resistance, anti-peeling property, flexibility, and the like.

(Patent document 1) JP-A 9-59700

(Patent document 2) JP-A 11-158782

DISCLOSURE OF THE INVENTION

It is hence an object of this invention to provide a leather-like sheet having a fine image drawn on its surface by an inkjet printing method. It is another object of this invention to provide a leather-like sheet which is excellent in abrasion resistance, light-resistant fastness, resistance to color migration, abrasion resistance, an anti-peeling property and flexibility and which is capable of enduring various uses of artificial leather. It is further another object of this invention to provide a process for the production of the above leather-like sheet.

The present inventors have made diligent studies with regard to methods of forming a fine image on the surface of a leather-like sheet and as a result has found the following. When open pores are formed on the surface of porous layer of a leather-like sheet for forming an image by an inkjet printing method, unexpectedly, a remarkably sharp image can be formed, the image is strongly held on the porous layer, and there can be obtained a leather-like sheet which is excellent in abrasion resistance, light-resistant fastness, resistance to color migration, abrasion resistance, an anti-peeling property and flexibility. This invention has been accordingly completed.

That is, this invention is a leather-like sheet comprising (i) a fibrous substrate and (ii) a porous layer thereon, the porous layer having a surface having open pores with a diameter of 1 μm or more and the porous layer having the surface having an image whose definition is 5 dots/mm or more.

Further, this invention is a process for the production of leather-like sheet, which comprises the steps of (i) forming a porous layer of a elastic polymer on a fibrous substrate, (ii) removing a surface layer of the porous layer to form open pores, and (iii) forming an image on the porous layer surface provided with the open pores, by an inkjet printing method.

BRIEF DESCRIPTION OF DRAWINGS

FIG. 1 shows one example of cross-sectional form of a porous layer.

1 Fibrous substrate

2 Porous layer

3 Space

BEST MODE FOR CARRYING OUT THE INVENTION

This invention will be explained in detail below.

<Leather-Like Sheet>

(Fibrous Substrate)

The leather-like sheet of this invention has a porous layer on a fibrous substrate. As a fibrous substrate, a fiber aggregate can be used. The fiber aggregate includes a composite fiber aggregate obtained by impregnating a fibrous aggregate with a elastic polymer. The fiber aggregate is preferably selected from those which are conventionally used for artificial leather.

The fiber aggregate includes a nonwoven fabric and a woven or knitted cloth. Examples of the fiber for constituting the fiber aggregate include synthetic fibers of polyester, polyamide, etc., natural fibers of cotton, hemp, wool, etc., and semi-synthetic fibers of rayon, etc. A mixture of two or more of these may be also used. In particular, the fibrous substrate is preferably a nonwoven fabric or a composite nonwoven fabric obtained by impregnating a nonwoven fabric with a elastic polymer.

The fiber aggregate is preferably an aggregate containing ultrafine fibers. The ultrafine fibers are fibers whose single fiber fineness is preferably 0.3 dtex or less, more preferably 0.1 to 0.0001 dtex.

The fiber aggregate is preferably a nonwoven fabric in which ultrafine fibers are intertwined. When the single fiber fineness is decreased, a fibrous substrate obtained comes to have a smoother surface, and a fine pattern drawn by an inkjet printing method or the like can be more improved in appearance.

The above ultrafine fibers can be produced by a known method. For example, there can be employed a method of producing a synthetic fiber by an islands-in-sea spinning method, a blend spinning method, a split multi-component fiber spinning method or the like. In these fibers, as-spun fibers having a relatively large size before the formation of ultrafine fibers are converted to staple fibers, then, the staple fibers are opened with a known carding machine and intertwined with a needling machine, etc., to prepare a nonwoven fabric, and then they are converted to ultrafine fibers, whereby a nonwoven fabric comprising ultrafine fibers is formed. As a method of forming ultrafine fibers, there can be employed a method in which components other than those which form ultra-fine fibers are removed, by extraction or decomposition, from the as-spun fibers obtained by an islands-in-sea spinning method and a blend spinning method. Further, there can be employed a method in which as-spun fibers obtained by a split composite spinning method are mechanically or chemically split. Polymer components that are removed by extraction or decomposition include polyethylene, polypropylene, polystyrene or copolymers of these. Polymer components for forming ultrafine fibers include polyesters such as polyethylene terephthalate, polyethylene naphthalate, etc., and polyamides such as nylon 6, nylon 66, etc. For efficient production, preferably, split composite fibers are spun and directly formed into webs, and then they are intertwined with a needling machine, etc., and subjected to mechanical splitting treatment, etc., to form an ultrafine nonwoven fabric.

The composite fiber aggregate formed of a fiber aggregate and a elastic polymer includes an aggregate obtained by impregnating a fiber aggregate with a elastic polymer, coagulating the elastomer and drying it. Examples of the elastic polymer include a polyurethane, a polyester-based elastomer, a polyamide-based elastomer, a polyolefin-based elastomer and synthetic rubbers such as polybutadiene, polyisoprene, etc. Of these, a polyurethane is preferred in view of abrasion resistance, an elastic recovery property, flexibility, etc. The elastic polymer is used for the impregnation in the form of a solution or dispersion of it in an organic solvent. Preferably, it is used for the impregnation in the form of an aqueous solution or aqueous dispersion from the viewpoint of the protection of the global environment and the protection of the working environment as well.

The thickness of the fibrous substrate is preferably 0.2 to 5 mm, more preferably 0.4 to 2.5 mm.

(Porous Layer)

The leather-like sheet of this invention has a porous layer on the fibrous substrate. The thickness of the porous layer is preferably in the range of 0.05 to 1.5 mm. When the above thickness is less than 0.05 mm, the valleys and hills of the fibrous substrate cannot be concealed and it is difficult to obtain a surface smoothness. When the thickness of the porous layer exceeds 1.5 mm, undesirably, the texture of the leather-like sheet becomes rubbery.

The density of the porous layer is preferably in the range of 0.2 to 0.7 g/cm$^3$, more preferably 0.3 to 0.5 g/cm$^3$. When the above density is in this range, the leather-like sheet comes to have fine texture.

The porous layer is preferably formed of a elastic polymer. The elastic polymer is selected from those that are used for the composite fiber aggregate that is used as a substrate. The porous layer is preferably formed of a polyurethane.

The polyurethane is preferably selected from those that are used for artificial leather. The polyurethane includes a thermoplastic polyurethane obtained by polymerization of an organic diisocyanate, a high-molecular-weight diol and a chain extender. The organic diisocyanate is preferably an aliphatic, alicyclic or aromatic diisocyanate having two isocyanate groups per molecule. The organic diisocyanate includes 4,4'-diphenylmethane diisocyanate, p-phenylene diisocyanate, toluylene diisocyanate, 1,5-naphthalene diisocyanate, xylylene diisocyanate, hexamethylene diisocyanate, isophorone diisocyanate, 4,4'-dicyclohexylmethane diisocyanate, etc. The high-molecular-weight diol includes polymer glycols having an average molecular weight of 500 to 4,000 such as a polyester glycol obtained by polycondensation of glycol and aliphatic dicarboxylic acid, a polylactone glycol obtained by ring-opening polymerization of lactone, an aliphatic or aromatic polycarbonate glycol, a polyether glycol, and at least one of these is selected. The chain extender includes diols having two hydrogen atoms that can react with the isocyanate and having a molecular weight of 500 or less, such as ethylene glycol, 1,4-butanediol, hexamethylene glycol, xylylene glycol, cyclohexane diol, neopentyl glycol, etc.

Inside the porous layer, a plurality of pores are formed and arranged at random. The diameters of the pores tend to decrease toward the surface. FIG. 1 shows one example of cross-sectional form of the porous layer.

The pores may be communicating pores or may be independent pores. For the texture of the leather-like sheet, communicating pores are preferred.

(Open Pores)

The surface of the porous layer has open pores having a diameter of 1 μm or more. The open pores preferably communicate with the fibrous substrate. When the leather-like sheet has communicating pores, it is excellent in air permeability and moisture vapor permeability.

The leather-like sheet of this invention has a fine image on the porous layer surface thereof. In the leather-like sheet of this invention, it is assumed that an ink constituting the image goes into pores existing on the porous layer surface, and therefore, that, differing from a case where an ink is applied only to a flat surface, the ink is held from coming off even when the surface is abraded. Further, while an ink adhering to a flat surface is easily peeled off due to the flexing of a leather-like sheet, the leather-like sheet of this invention does not easily cause an ink to peel off.

The diameter of each of the open pores is preferably 1 to 150 μm, more preferably 3 to 100 μm, particularly preferably 10 to 80 μm. When the above diameter is less than 1 μm, no ink effectively goes into the pores, and it is hence impossible to attain the abrasion resistance or tenacity against peeling as an end of this invention. In particular, when a pigment ink excellent in colorfastness is used, the diameter of ink particles is large, and the above phenomenon is more apparent. Further, when the diameter of the open pores is too large, ink particles go deep into the pores to hamper the fineness of an image, and the definition of the image on the leather-like sheet obtained is liable to be decreased. Therefore, the average diameter of the open pores is preferably in the range of 1 to 100 μm, more preferably 5 to 70 μm.

The form of the open pores existing on the surface correlates to the surface state of the leather-like sheet. When the leather-like sheet is a grained leather-like sheet (artificial leather) whose surface has a smooth face, the number of the open pores is small. The number of the open pores per $cm^2$ in the grained leather-like sheet is preferably in the range of 100 to 5,000, more preferably 500 to 3,000. The average diameter of the open pores is preferably in the range of 5 to 70 μm, more preferably 10 to 30 μm. When the number and average diameter of the open pores are in these ranges, a high-definition image can be formed. Further, the total area of the open pores to a projection area of the surface is preferably 1% or less.

When the leather-like sheet is a nubuck-like leather-like sheet (artificial leather), that is, it has a surface fluffing (nubuck) like natural leather, preferably, the entire surface thereof is of open pores.

Even if the leather-like sheet of this invention is a nubuck-like leather-like sheet having a surface full of microscopic valleys and hills, when a unidirectionally ejected ink like the inkjet is used, a fine pattern can be formed on the leather-like sheet surface, the influence of the microscopic valleys and hills on the surface does not much decrease the definition, and gives produces an effect that the leather-like sheet is improved in durability such as fastness against abrasion.

(Image)

The leather-like sheet of this invention has an image having a definition of 5 dots/mm or more, preferably 10 to 100 dots/mm, on the porous layer. An image having such a fine definition can be printed with a 360 dots/inch or 720 dots/inch inkjet printer.

The image is preferably formed of a pigment ink. When a pigment ink is used, an image formed is excellent in light resistance and resistance to color migration since it has a larger particle size than a dye ink. As a pigment, any one of a water-soluble pigment, a solvent-soluble pigment or a UV-curing pigment can be used. The leather-like sheet of this invention has an image that is not formed on the conventional flat and smooth surface but is formed on the surface having open pores, so that it is also excellent in physical properties such as adhesion strength, etc.

(Protective Layer)

The leather-like sheet of this invention preferably has a protective layer on the porous layer having an image. The protective layer is preferably formed of a elastic polymer. The protective layer improves the physical properties and texture of the leather-like sheet and the abrasion resistance of the surface. Further, an interlayer bonding strength of the protective layer and the porous layer can be fully obtained. The leather-like sheet of this invention has microscopic valleys and hills of open pores on the surface and, further, it does not have much ink adhering to the smooth surface thereof. In spite of the existence of an image, therefore, the protective layer can be formed as one excellent in abrasion resistance and an anti-peeling property.

Examples of the elastic polymer for the protective layer include polyurethane, polyester, a polyester-based elastomer, polyamide, polyethylene, polypropylene, polyvinyl chloride, polyvinylidene chloride, etc. Of these, polyurethane is preferred in view of physical properties. For maintaining the sharpness of an image, this elastic polymer is also preferably transparent or semi-transparent. The thickness of the protective layer is preferably 0.01 mm or more, more preferably 0.02 to 1 mm.

Owing to the protective layer, the image drawn on the leather-like sheet surface can be protected to a high degree, and the leather-like sheet surface is improved in abrasion resistance and resistance to color migration. Further, when the sheet is flexed, the layer on which a pattern is drawn does not easily undergo a cracking, and the leather-like sheet can be suitably applied to the use field where flexibility like artificial leather is required.

In this invention, further, one or more protective layers formed of a elastic polymer may be formed on the protective layer that is in contact with a printed surface. When a plurality of the protective layers are stacked, the sheet can be improved in physical properties and texture. Examples of the above elastic polymer include polyurethane, polyester, a polyester-based elastomer, polyamide, polyethylene, polypropylene, polyvinyl chloride, polyvinylidene chloride, etc.

The above elastic polymer layer may be formed on a release sheet and then bonded with an adhesive. Or, a sheet having an image may be formed, then, an organic solvent solution, an organic solvent dispersion, aqueous solution or aqueous dispersion of the elastic polymer is coated thereon and a formed coating is dried to form the elastic polymer layer. The coating method may be selected from knife coating, roll coating, spraying and gravure coating.

(Process for the Production of Leather-Like Sheet)

The process for the production of a leather-like sheet, provided by this invention, comprises the following steps of (i) forming a porous layer of a elastic polymer on a fibrous substrate, (ii) removing a surface layer of the porous layer, to form open pores, and (iii) forming an image on the porous layer surface provided with the open pores, by an inkjet printing method.

(Step (i): Formation of Porous Layer)

The step (i) is a step in which a porous layer of a elastic polymer is formed on a fibrous substrate. The fibrous substrate has been already explained. The fibrous substrate is preferably a nonwoven fabric or a composite nonwoven fabric obtained by impregnating a nonwoven fabric with a elastic polymer.

Examples of the elastic polymer include polyurethane, a polyester-based elastomer, a polyamide-based elastomer, a polyolefin-based elastomer and synthetic rubbers such as polybutadiene, polyisoprene, etc. Of these, polyurethane is preferred in view of abrasion resistance, an elastic recovery property, flexibility, etc.

The porous layer can be formed by applying a solution of the elastic polymer in an organic solvent onto the substrate and then removing the solvent by a dry method or a wet method. Further, it can be also formed by incorporating thermally expandable capsules or inert gas into a solution of the elastic polymer and applying the solution onto the substrate.

For example, the porous layer can be formed by dissolving the elastic polymer in an organic solvent that is a good solvent to the elastic polymer and that is compatible with water, applying the resultant solution onto the substrate and then immersing the substrate in a water bath to coagulate the elastic polymer (wet coagulation method). Alternatively, the porous layer can be formed by dissolving or dispersing the elastic polymer in an organic solvent that has no compatibility with water but can dissolve or disperse the elastic polymer, applying the resultant solution or dispersion onto the substrate and selectively evaporating the organic solvent while keeping water from being evaporated (dry pore forming method).

Further, the porous layer can be formed by dispersing thermally expandable fine particle capsules in aqueous solution or aqueous dispersion of the elastic polymer, applying the resultant dispersion to the substrate and expanding the thermally expandable capsules while drying. It can be also formed by mixing a prepolymer of a elastic polymer having an alcoholic hydrogen in its molecular terminal, polyisocyanate and water and immediately thereafter applying the mixture onto the substrate.

The porous layer can be also formed by dispersing inert gas in the melted elastic polymer and applying the resultant dispersion onto the substrate to foam the applied mixture. Further, the porous layer can be formed by applying a solution or dispersion of a mixture of the elastic polymer and a chemical foaming agent onto the substrate to foam the applied mixture. Of these, the wet coagulation method is particularly preferred, since the form of pores can be easily controlled and since pores communicating with the fibrous substrate can be easily obtained.

Therefore, the step (i) of forming the porous layer preferably includes the steps of (i-1) applying a solution containing the elastic polymer and an organic solvent onto the fibrous substrate, (i-2) impregnating the resultant laminate in water to coagulate the elastic polymer.

The porous layer can be formed by direct application onto the fibrous substrate. Further, a porous film formed on a release paper may be bonded to the fibrous substrate with an adhesive, etc., to form the porous layer.

(Step (ii): Formation of Open Pores)

The step (ii) is a step in which a surface layer of the porous layer is removed to form open pores. The porous layer has spaces inside as shown in FIG. 1, and a surface layer of the elastic polymer is formed on the surface thereof. In this step, this surface layer is removed.

The open pores can be formed by applying a solvent onto the surface layer of the porous layer and dissolving the surface layer to remove it. The solvent includes a good solvent to the elastic polymer that constitutes the porous layer, a poor solvent, a mixture of a good solvent and a poor solvent, and a mixture of a good solvent and a non-solvent.

The good solvent as used herein means a solvent capable of dissolving the elastic polymer. When the elastic polymer is a polyurethane synthesized from an aromatic organic diisocyanate, the good solvent includes polar solvents such as dimethylformamide, tetrahydrofuran, dioxane, etc. The poor solvent refers to a solvent that does not dissolve, but can swell, the elastic polymer. When the elastic polymer is a polyurethane, the poor solvent includes ketones such as methyl ethyl ketone, etc., alcohols such as isopropyl alcohol, etc., and aromatic solvents such as toluene, etc.

The non-solvent refers to a solvent that neither dissolves nor swells the elastic polymer. When the elastic polymer is a polyurethane, typically, the non-solvent includes water, etc.

When these solvents are selected, the solubility to a component constituting the porous layer actually used can be adjusted, and proper open pores can be formed. When a solvent having too high solubility is used, open pores are once formed, but due to its too high solubility, they are closed again in the process of evaporating the solvent for drying. When a solvent having too low solubility is used, the open pores are not formed.

The solvent can be applied with a gravure roll, etc. The size of mesh of the gravure roll has a great influence on the size of diameter of open pores to be formed. That is, when a roll having a mesh of fine openings is used, open pores having a relatively small diameter each are obtained. When a roll having a mesh of wide openings is used, open pores having a relatively large diameter each are obtained. Further, the pressure by the application has an influence on the size of diameter of the open pores. That is, when the application pressure is high, the diameter of the open pores obtained is large. When the application pressure is low, the diameter of the open pores obtained is small.

On the basis of the selection of a proper solvent, the selection of a gravure mesh roll and the optimization of the application pressure, open pores having a diameter of 1 μm or more can be formed on the surface of the porous layer. The average diameter of the open pores is preferably in the range of 1 to 100 μm, more preferably 5 to 70 μm, still more preferably 10 to 30 μm.

According to the above method, a grained leather-like sheet (artificial leather) whose surface has a smooth face can be produced. According to the above method, further, the open pores are easily uniformly formed and can be kept from varying. Further, the number of open pores is small, and an image of a remarkably high definition can be easily formed. The number of the open pores on the grained face is preferably in the range of 100 to 3,000 per $cm^2$. The total area of the open pores on the surface relative to the projection area of the surface is preferably 1% or less.

Further, the open pores can be formed by grinding the surface of the porous layer to remove a surface layer. The grinding can be carried out in a manner that the surface of the porous layer is ground (polished) with a sand paper or that a surface is sliced off with a slicer.

According to the above method, there can be obtained a leather-like sheet having a nubuck-like surface, that is, a surface in which the open pores are like fluffing (nubuck) of natural leather. In this case, the leather-like sheet surface is mostly of the open pores. Even when the leather-like sheet has the above nubuck-like surface full of microscopic valleys and hills, the formation of an image by an inkjet printing method uses a unidirectionally ejected ink, so that a fine pattern can be formed on the surface, and the influence by the microscopic valleys and hills on the surface does not much decrease the definition of the image but instead improves the leather-like sheet in durability such as fastness against abrasion.

(Step (iii): Formation of Image)

The step (iii) is a step in which an image is formed on the porous layer provided with the open pores, by an inkjet printing method.

The ink for use with the inkjet printing method is preferably a pigment ink in view of light-resistant fastness and resistance to color migration. When a pigment ink is used, an image is excellent in light-resistant fastness and resistance to color migration since it has a larger particle size than a dye ink. The leather-like sheet of this invention has an image that is not formed on a conventional flat and smooth surface but is formed on the surface having the open pores, so that the image is excellent in adhesion strength.

As a dispersing medium for the pigment ink, there can be used any one of an organic solvent type, an aqueous type and a UV-curable type.

The pattern can be selected as required, and characters, photographs, designed pictures, etc., can be printed.

The printing can be performed with an inkjet printer. The inkjet printer prints a pattern on the open pore surface on the basis of data transmitted from an image extracting unit of a computer.

The definition of an image printed is preferably 5 dots/mm or more, more preferably 10 to 100 dots/mm. For printing an image having such a fine definition, a 360 dots/inch or 720 dots/inch inkjet printer can be used. The thus-printed leather-like sheet can be used as a commercial product as it is, while it is preferred to heat-treat the printed leather-like sheet at 80 to 150° C. for approximately 20 to 60 seconds after the formation of an image with an inkjet printer.

(Formation of Protective Layer)

In this invention, further, a protective layer may be formed on the surface having an image. The protective layer can be formed by coating the leather-like sheet surface having an image with an organic solvent solution, organic solvent dispersion, aqueous solution or aqueous dispersion of a elastic polymer and then drying a formed coating. The coating method can be selected from knife coating, roll coating, spraying or gravure coating.

A elastic polymer layer may be once formed on a release sheet and bonded to the leather-like sheet having an image. As an adhesive, conventionally known adhesives can be used, and of these, a polyurethane-containing adhesive (polyisocyanate-containing adhesive) is preferred. As an adhesive, any one of organic solvent type and aqueous type adhesives may be used.

The thickness of the protective layer is preferably 0.01 mm or more, more preferably approximately 0.02 to 1 mm.

EXAMPLES

This invention will be specifically explained in detail with reference to Examples hereinafter. In Examples, "part" and "%" are both based on a weight, and property measurement values were obtained by the following methods. In the following Examples, values for light-resistant fastness, resistance to color migration, abrasion resistance and tenacity against peeling were measured by the following methods.

(Light-Resistant Fastness)

After a leather-like sheet sample was irradiated with carbon arc light for 50 hours by a method according to JIS-L0824, it was observed for discoloration or fading. When it was free of any change, it was evaluated as being grade 5, when it retained no original pattern discernable due to severe discoloration or fading, it was evaluated as being grade 1, when it retained an original pattern but discolored, it was evaluated as being grade 3, and those which were between these grades were evaluated as being grades 4 and 2.

(Resistance to Color Migration)

leather-like sheets obtained in Examples and Comparative Examples were evaluated for color migration to a white artificial leather surface in a manner that a leather-like sheet having a pattern formed on its surface by an inkjet printing method and a general white artificial leather having a surface formed of polyurethane were attached face to face in a size of A6, a load of 2 kg was uniformly exerted, they were left in a 70° C. atmosphere for 3 days and then the white artificial leather surface was observed for the migration of a color thereto. When no color was migrated to the white artificial leather surface, the leather-like sheet was evaluated as being grade 5, when a color was migrated to color nearly the entire surface of white artificial leather, it was evaluated as being grade 1, and when 30 to 50% of the surface of white artificial leather was colored, it was evaluated as being grade 3.

(Abrasion Resistance)

According to an ASTM D-3886 method, HANDY ROLL P320J (supplied by NORTON COMPANY) was used as sand paper, and abrasion resistance data was how many times abrading operations were done until a urethane porous layer below a printed portion in an abraded portion was exposed to have a diameter of 10 mm.

(Tenacity against peeling)

According to a JIS K6301 method, a layer was peeled off 100 mm long at a tensile rate of 50 mm/minute and an average value of minimum values at five points at intervals of 20 mm was expressed in N/cm and used as tenacity against peeling.

(Flexibility)

According to a JIS K6545 method and JIS K6505 method, how many times operations were made before the cracking of a surface was counted and taken as flexibility.

(Measurement for Surface Open Pores)

A photograph of the surface of an obtained sheet having open pores was taken through a scanning electron microscope at a magnification of 100, open pores existing in a 1,000 μm×1,000 μm range in a measurement portion were measured for diameters, and a density of their number and an average diameter and a maximum diameter of the open pores were determined. In addition, when open pores were formed by mechanical grinding, a surface had no flat and smooth surface and numerous open pores are inter-communicated, so that the density of number of open pores was taken as being "numerous".

Example 1

Leather-Like Sheet-1

(Preparation of Fiber Aggregate-1)

Nylon-6 (intrinsic viscosity in m-cresol: 1.1) dried at 120° C. was fed into an extruder and melted. Separately, polyethylene terephthalate (intrinsic viscosity in o-chlorophenol: 0.64) dried at 160° C. was melted in other extruder different from the above. Then, a nylon-6 mixture molten stream was introduced at a duct polymer temperature of 250° C., and a polyethylene terephthalate molten stream was introduced at 300° C., into a spin block maintained at 275° C., and these two polymer molten streams were caused to flow together and compounded with a square spinneret having a grid-like array of hollow forming orifices. The compounded mixture was discharged at a rate of 2 g/minute-orifice and spun fibers were drawn at a high rate (approximately 4,860 m/minute as a spinning rate converted on the basis of a discharge amount and the fineness of a composite fiber) under an air pressure of 0.35 MPa. The drawn composite fibers were treated by applying a high voltage of −30 kV and caused to collide with a dispersing plate together with air stream to open them, and they were collected on a net conveyor in the form of a 1 m wide web formed of peel-split type composite fibers having a 16-split multiple-layer bonded type cross section. Then, the thus-obtained web was passed through a pair of upper and lower embossing-calender rolls hated at 100° C. to carry out thermal bonding. The resultant web was intertwined by needle punching and then immersed in water and it was lightly squeezed with a mangle and then subjected to peel-splitting treatment with a sheet-striking softening machine to give an ultrafine fiber nonwoven fabric having a basis weight of 210 g/m$^2$. Then, this nonwoven fabric was caused to shrink in a hot water at 70° C. to obtain a non-woven fabric having a 60% area based on the area that it had before shrunken.

The thus-obtained fiber aggregate-1 had a basis weight of 350 g/m$^2$, a thickness of 1.0 mm and a fineness of 0.15 dtex.

(Preparation of Composite Fiber Aggregate-1)

The fiber aggregate-1 was impregnated with a solution of 10% by weight of polyurethane (CRISVON TF50P, supplied by DIC Corporation (formerly Dainippon Ink & Chemicals, Inc.)) in dimethylformamide (to be referred to as "DMF" hereinafter), and then an excess solution on the fiber aggregate surface was scraped off. The impregnated fiber aggregate was immersed in water containing 5% of DMF for 20 minutes to coagulate the polyurethane and fully washed with water to remove DMF, and then fiber aggregate was dried at 120° C. for 4 minutes to give a composite fiber aggregate-1.

The thus-obtained composite fiber aggregate-1 had a surface formed of a mixture of fibers and polyurethane and had a basis weight of 455 g/m$^2$ and a thickness of 1.0 mm.

(Preparation of Sheet-1)

The surface of the composite fiber aggregate-1 was coated with a solution of 20% by weight of polyurethane (CRISVON TF50P, supplied by DIC Corporation (Dainippon Ink & Chemicals, Inc.)) in DMF (containing, as an additive, 0.3 part, per 100 parts of the solution, of SH28PA supplied by Dow Corning Toray Silicone Co., Ltd.) in a basis weight of 800 g/m$^2$. Then, the coated fiber aggregate was immersed in water containing 5% of DMF for 20 minutes to coagulate the polyurethane and fully washed with water to remove DMF, followed by drying at 120° C. for 5 minutes to give a sheet-1 having a density of 0.39 and having a polyurethane porous layer (wet porous layer). The tenacity of the sheet-1 against peeling was 31.2 N/cm, which was strength sufficient for various uses of artificial leather including the use for sport shoes.

(Open Pores)

A mixture of 40% of methyl ethyl ketone with 60% of dimethylformamide was applied to the surface of the sheet-1 under a pressure of 4 kg/cm$^2$ with a gravure coater (using 110 mesh roll) to dissolve the surface of the polyurethane porous layer, followed by drying to form open pores, whereby a leather-like sheet-1 was obtained.

The surface of the thus-obtained leather-like sheet-1 was observed through a scanning electron microscope to show that open pores having an average diameter of 30 μm were formed at a rate of 2,050 pieces per square centimeter. The maximum diameter of the open pores was 55 μm.

(Printing)

A landscape picture having a definition of 720 DPI (dots/inch) was printed on the surface of the open-pore sheet-1 with an inkjet printer (SJ-545EX, supplied by Roland DG Corporation) using organic-solvent-based pigment inks (ECO-SOLMAX), and then, the printed sheet was heat-treated at 120° C. for 1 minute to give a leather-like sheet (artificial leather)-1. The inks used were cyan ESL3-CY, magenta ESL3-MG, yellow ESL3-YE, light cyan ESL3-LC, light magenta ESL3-LM and black ESL3-BK.

The leather-like sheet-1 had a fine and sharp image printed on the surface thereof. When the surface was tested for light-resistant fastness, the surface was free of any change and it was evaluated as being grade 5 and was excellent. Further, the surface did not cause any color migration, and it was evaluated as being grade 5 and was excellent in resistance to color migration. The tenacity of the printed leather-like sheet-1 against peeling was 30.7 N/cm, and when the tenacity against peeling was measured, a peeling site was an interface between the nonwoven fabric layer and the polyurethane porous layer before the inkjet printing. Further, the data for abrasion resistance thereof was 370 times. Table 1 shows the physical properties thereof.

Example 2

Leather-Like Sheet-2

(Open Pores)

A buffing machine fitted with 200 mesh sand paper was adjusted with regard to the number of rotation of sand paper-fitted rolls and a gap between the rolls such that the surface of the sheet-1 obtained in Example 1 would have open pores having an average diameter of 50 μm, and the surface of the sheet-1 was ground with the buffing machine to give an open pore sheet-2. The obtained open pores numerously existed, and the open pores had a maximum diameter of 110 μm and an average diameter of 55 μm.

(Printing)

A landscape picture having a definition of 720 DPI (dots/inch) was printed on the surface of the open-pore sheet-2 with an inkjet printer (SJ-545EX, supplied by Roland DG Corporation) using organic-solvent-based pigment inks (ECO-SOLMAX), and then, the printed sheet was heat-treated at 120° C. for 1 minute to give a leather-like sheet (artificial leather)-2. The inks used were cyan ESL3-CY, magenta ESL3-MG, yellow ESL3-YE, light cyan ESL3-LC, light magenta ESL3-LM and black ESL3-BK.

The printed leather-like sheet-2 had a fine and sharp image printed on the surface thereof. When the surface was tested for light-resistant fastness, the surface was free of any change and it was evaluated as being grade 5 and was excellent. Further, the surface did not cause any color migration, and it was evaluated as being grade 5 and was excellent in resistance to color migration. The tenacity of the printed leather-like sheet-2 against peeling was 31.2 N/cm, and when the tenacity against peeling was measured, a peeling site was an interface between the nonwoven fabric layer and the polyurethane porous layer before the inkjet printing. Further, the data for abrasion resistance thereof was 320 times. Table 1 shows the physical properties thereof together.

Examples 3 and 4

Leather-Like Sheets-3 and -4

A release sheet (R53, supplied by LINTEC Corporation) was coated with a basis weight of 90 g/m$^2$ of a composition liquid which had been prepared by mixing a thickener with 100 parts of a 33% aqueous dispersion of a polyurethane resin and stirring the mixture so that it had a viscosity of 8,000 CPS, followed by drying at a temperature of 70° C. for 2 minutes and drying at 110° C. for 2 minutes, to give a film of a elastic polymer. Further, the surface thereof was coated with a basis weight of 80 g/m$^2$ of a composition liquid which had been prepared by mixing a thickener with 100 parts of a water-dispersible polyurethane-based adhesive so that it had a viscosity of 5,000 CPS, followed by drying at a temperature of 90° C. for 2 minutes.

Then, the elastic polymer on the release sheet and the leather-like sheet-1 obtained in Example 1 were attached to each other, and the resultant set was press-bonded on a hot cylinder having a temperature of 110° C. by passing it through a gap of 0.6 mm between the cylinder and a roll. Then, the bonded set was left in an atmosphere at a temperature of 60° C. for 2 days and then the release sheet was peeled off to give a leather-like sheet-3.

Further, a leather-like sheet-4 was obtained in the same manner as above except that the leather-like sheet-1 obtained in Example 1 was replaced with the leather-like sheet-2 obtained in Example 2.

The thus-obtained leather-like sheets-3 and 4 were excellent in light-resistant fastness and resistance to color migration. They also had high tenacity against peeling, and when they are measured for tenacity against peeling, their peeling sites were in the nonwoven fabric layers before the inkjet printing. Further, they were also excellent in abrasion resistance. Table 1 shows the physical properties thereof together.

Example 5

Leather-Like Sheet-5

A leather-like sheet (artificial leather)-5 was obtained in the same manner as in Example 2 except that the landscape picture having a definition of 720 DPI (dots/inch) was printed on the surface of the open-pore sheet-2 obtained in Example 2 using water-base pigment inks (PX-P ink), in place of the organic-solvent-based pigment inks, with an inkjet printer (PM-4000PX, supplied by EPSON Corporation), and that the heat treatment was carried out at 120° C. for 1 minute. The inks used were cyan ICC23, magenta ICM23, yellow ICY23, light cyan ICLC23, light magenta ICLM23, grey ICGY23, photo black ICBK23 and mat black ICMB23.

The thus-obtained leather-like sheet-5 had a fine and sharp image printed on the surface thereof. When the surface was tested for light-resistant fastness, the surface was free of any change and it was evaluated as being grade 5 and was excellent. Further, the surface did not cause any color migration, and it was evaluated as being grade 5 and was excellent in resistance to color migration. The tenacity of the printed leather-like sheet-5 against peeling was 30.8 N/cm, and when the tenacity against peeling was measured, a peeling site was an interface between the nonwoven fabric layer and the polyurethane porous layer before the inkjet printing. Further, the data for abrasion resistance thereof was 330 times. Table 1 shows the physical properties thereof together.

Example 6

Leather-Like Sheet-6

A leather-like sheet (artificial leather)-6 was obtained in the same manner as in Example 2 except that the landscape picture having a definition of 720 DPI (dots/inch) was printed on the surface of the open-pore sheet-2 obtained in Example 2 using UV-curable pigment type inks (cyan, magenta, yellow, light cyan, light magenta and black), in place of the organic-solvent-based pigment inks, with an inkjet printer (RP-720UVZ, supplied by Raster Printers, Inc.).

The thus-obtained leather-like sheet-6 had a fine and sharp image printed on the surface thereof. When the surface was tested for light-resistant fastness, the surface was free of any change and it was evaluated as being grade 5 and was excellent. Further, the surface did not cause any color migration, and it was evaluated as being grade 5 and was excellent in resistance to color migration. The tenacity of the printed leather-like sheet-6 against peeling was 29.7 N/cm, and when the tenacity against peeling was measured, a peeling site was an interface between the nonwoven fabric layer and the polyurethane porous layer before the inkjet printing. Further, the data for abrasion resistance thereof was 590 times. Table 1 shows the physical properties thereof together.

Comparative Example 1

A landscape picture having a definition of 720 DPI (dots/inch) was printed with an inkjet printer (SJ-545EX, supplied by Roland DG Corporation) using organic-solvent-based pigment inks (ECO-SOLMAX) in the same manner as in Example 1 except that the open-pore sheet-1 in Example 1 was replaced with the sheet-1 obtained in the middle of procedures of Example 1, to give artificial leather.

The thus-obtained artificial leather had a fine and sharp image printed on the surface thereof. When the surface was tested for light-resistant fastness, the surface was free of any change and it was evaluated as being grade 5 and was excellent. Further, the surface did not cause any color migration, and it was evaluated as being grade 5 and was excellent in resistance to color migration. However, the tenacity thereof against peeling was as low as 5.2 N/cm, a peeling site was in the pigment layer formed by the inkjet printing and the artificial leather was not any product having durability against various uses as artificial leather. Further, the data for abrasion resistance thereof was 10 times because of the peeling of the pigment layer. Table 1 shows the physical properties thereof together.

TABLE 1

| | Ex. 1 | Ex. 2 | Ex. 3 | Ex. 4 | Ex. 5 | Ex. 6 | C. Ex. 1 |
|---|---|---|---|---|---|---|---|
| Fiber aggregate No. | 1 | 1 | 1 | 1 | 1 | 1 | 1 |
| Fineness of fibers dtex | 0.15 | 0.15 | 0.15 | 0.15 | 0.15 | 0.15 | 0.15 |
| Elastic polymer layer | Yes | Yes | Yes | Yes | Yes | Yes | Yes |
| Method of forming open pores | Application of solvent | Mechanical grinding | Application of solvent | Mechanical grinding | Mechanical grinding | Mechanical grinding | No |
| Maximum Diameter μm | 55 | 110 | 55 | 110 | 110 | 110 | — |

TABLE 1-continued

| | Ex. 1 | Ex. 2 | Ex. 3 | Ex. 4 | Ex. 5 | Ex. 6 | C. Ex. 1 |
|---|---|---|---|---|---|---|---|
| Average diameter μm | 30 | 55 | 30 | 55 | 55 | 55 | — |
| Density pieces/cm$^2$ | 2050 | Numerous | 2050 | Numerous | Numerous | Numerous | — |
| Coloring inks | Organic-solvent-based pigment inks | Organic-solvent-based pigment inks | Organic-solvent-based pigment inks | Organic-solvent-based pigment inks | Water-base pigment inks | UV-curable pigment inks | Organic-solvent-based pigment inks |
| Surface finish (Protective layer) | No | No | Water-base laminate | Water-base laminate | No | No | No |
| Tenacity against peeling N/cm | 30.7 | 31.2 | 35.2 | 32.1 | 30.8 | 29.7 | 5.2 |
| Abrasion resistance, times | 370 | 320 | 1290 | 1320 | 330 | 590 | 10 |
| Flexibility, times | 10500 | 11000 | 11000 | 11500 | 10000 | 9500 | 9000 |
| Light-resistant fastness, grade | 5 | 5 | 5 | 5 | 5 | 5 | 5 |
| Resistance to color migration, grade | 5 | 5 | 5 | 5 | 5 | 5 | 5 |

Ex.: Example C. Ex.: Comparative Example

Example 7

Leather-Like Sheet-7

(Preparation of Fiber Aggregate-7)

Nylon 6 and a low-density polyethylene were mixed in a mixing ratio of 50/50, and the mixture was melted and mixed with an extruder and blend-spun at 290° C. The spun fibers were drawn, followed by lubricant treatment and cutting, to give 51 mm long fibers having a fineness of 5.5 dtex. These fibers were passed through the steps of carding, cross-wrapping, needling and calendering, to give a fiber aggregate-7 having a weight of 400 g/m$^2$, a thickness of 1.6 mm and an apparent density of 0.25 g/cm$^3$.

(Preparation of Composite Fiber Aggregate-7)

The fiber aggregate-7 was immersed in a solution of 10% by weight of polyurethane (CRISVON TF50P, supplied by DIC Corporation (Dainippon Ink & Chemicals, Inc.)) in DMF. Then, an excess solution on the fiber aggregate surface was scraped off and the fiber aggregate was compressed by squeezing bar to 90% of the substrate thickness to give a composite fiber aggregate-7.

(Preparation of Sheet-7)

Before recovering from compression, the composite fiber aggregate-7 was coated with a solution of 20% by weight of polyurethane (CRISVON TF50P, supplied by DIC Corporation (Dainippon Ink & Chemicals, Inc.)) in DMF (containing, as an additive, 0.3 part, per 100 parts of the solution, of SH28PA supplied by Dow Corning Toray Silicone Co., Ltd.) in a basis weight of 800 g/m$^2$. Then, the coated composite fiber aggregate-7 was immersed in water containing 5% of DMF to coagulate the polyurethane, and it was fully washed with water to remove DMF. Then, it was dried at 120° C. to give a sheet having a polyurethane porous layer. The thus-obtained sheet was repeatedly compressed and relaxed in a hot toluene at 90° C. to extract and remove polyethylene in the fibers, whereby there was prepared a sheet-7 using ultrafine fibers having a fineness of 0.003 dtex as a fibrous substrate and having the polyurethane porous layer. The tenacity of the thus-obtained sheet-7 against peeling was 35.7 N/cm, which was strength sufficient for various uses of artificial leather including the use for sport shoes.

(Open Pores)

A mixture of dimethylformamide:methyl ethyl ketone=7:3 was applied to the surface of the sheet-7 under a pressure of 4 kg/cm$^2$ with a gravure applicator (using a 150-mesh roll) using a 110-mesh gravure roll to dissolve the polyurethane on the surface, followed by drying to form open pores. The surface of the thus-obtained open-pore sheet-7 was observed through a scanning electron microscope to show that open pores having an average diameter of 15 μm were formed at a rate of 1,800 pieces/cm$^2$. The maximum diameter of these open pores was 40 μm.

(Printing)

A landscape picture having a definition of 720 DPI (dots/inch) was printed with an inkjet printer (SJ-545EX, supplied by Roland DG Corporation) using organic-solvent-based pigment inks (ECO-SOLMAX) in the same manner as in Example 1 except that the open-pore sheet-1 was replaced with the open-pore sheet-7, to give a leather-like sheet (artificial leather)-7.

The thus-obtained leather-like sheet-7 had a fine and sharp image printed on the surface thereof. When the surface was tested for light-resistant fastness, the surface was free of any change and it was evaluated as being grade 5 and was excellent. Further, the surface did not cause any color migration, and it was evaluated as being grade 5 and was excellent in resistance to color migration. The tenacity of the printed leather-like sheet-7 against peeling was 36.2 N/cm, and when the tenacity against peeling was measured, a peeling site was an interface between the nonwoven fabric layer and the polyurethane porous layer before the inkjet printing. Further, the data for abrasion resistance thereof was 440 times. Table 2 shows the physical properties thereof.

Example 8

Leather-Like Sheet-8

(Printing)

A leather-like sheet (artificial leather)-8 was obtained in the same manner as in Example 7 except that the landscape picture having a definition of 720 DPI (dots/inch) was printed on the surface of the open-pore sheet-7 obtained in Example 7 using water-base pigment inks (PX-P ink), in place of the organic-solvent-based pigment inks, with an inkjet printer (PM-4000PX, supplied by EPSON Corporation), and that the heat treatment was carried out at 120° C. for 1 minute. The inks used were cyan ICC23, magenta ICM23, yellow ICY23, light cyan ICLC23, light magenta ICLM23, grey ICGY23, photo black ICBK23 and mat black ICMB23.

The thus-obtained leather-like sheet-8 had a fine and sharp image printed on the surface thereof. When the surface was tested for light-resistant fastness, the surface was free of any change and it was evaluated as being grade 5 and was excellent. Further, the surface did not cause any color migration, and it was evaluated as being grade 5 and was excellent in resistance to color migration. The tenacity of the printed leather-like sheet-8 against peeling was 30.5 N/cm, and when the tenacity against peeling was measured, a peeling site was an interface between the nonwoven fabric layer and the polyurethane porous layer before the inkjet printing. Further, the data for abrasion resistance thereof was 390 times. Table 2 shows the physical properties thereof together.

Example 9

Leather-Like Sheet-9

(Formation of Protective Layer)

A release sheet (R53, supplied by LINTEC Corporation) was coated with a basis weight of 90 g/m$^2$ of a composition liquid which had been prepared by mixing a thickener with 100 parts of a 33% aqueous dispersion of a polyurethane resin and stirring the mixture so that it had a viscosity of 8,000 CPS, followed by drying at a temperature of 70° C. for 2 minutes and drying at 110° C. for 2 minutes, to give a film of a elastic polymer. Further, the surface thereof was coated with a basis weight of 80 g/m$^2$ of a composition which had been prepared by mixing a thickener with 100 parts of a water-dispersible polyurethane-based adhesive so that it had a viscosity of 5,000 CPS.

(Printing)

A landscape picture having a definition of 720 DPI (dots/inch) was printed on the surface of the open-pore sheet-7 obtained in Example 7 using UV-curable pigment type inks (cyan, magenta, yellow, light cyan, light magenta and black) with an inkjet printer (RP-720UVZ, supplied by Raster Printers, Inc.), to give a leather-like sheet (artificial leather)-9.

(Lamination)

Then, the leather-like sheet-9 was dried at a temperature of 90° C. for 2 minutes, then, the elastic polymer on the release sheet and the leather-like sheet-9 were attached to each other and the resultant laminate was press-bonded by passing it through a gap of 0.8 mm between rolls. Then, the bonded laminate was left in an atmosphere at a temperature of 60° C. for 2 days and then the release sheet was peeled off to give a leather-like sheet-9 having a protective layer.

The thus-obtained leather-like sheet-9 had a fine and sharp image printed on the surface thereof. The leather-like sheet-9 was excellent in light-resistant fastness and resistance to color migration. The tenacity of the printed leather-like sheet-9 against peeling was 34.7 N/cm, and when the tenacity against peeling was measured, a peeling site was an interface between the nonwoven fabric layer and the polyurethane porous layer before the inkjet printing. Further, the data for abrasion resistance thereof was 1,360 times. Table 2 shows the physical properties thereof together.

Example 10

Leather-Like Sheet-10

(Printing)

A leather-like sheet (artificial leather)-10 was obtained in the same manner as in Example 7 except that the landscape picture having a definition of 720 DPI (dots/inch) was printed on the surface of the open-pore sheet-7 obtained in Example 7 using dye inks (IC5CLO6 and IC1BK05), in place of the organic-solvent-based pigment inks, with an inkjet printer (PM-3700C, supplied by EPSON Corporation). The tenacity of the thus-obtained leather-like sheet-10 against peeling was 32.9 N/cm, the data for abrasion resistance thereof was 410 times and the data for flexibility thereof was 12,500 times.

Comparative Example 2

A landscape picture having a definition of 720 DPI (dots/inch) was printed with an inkjet printer (PM-3700C, supplied by EPSON Corporation) using dye inks (IC5CLO6 and IC1BK05) in the same manner as in Example 10 except that the open-pore sheet-7 obtained in Example 7 was replaced with the sheet-7 free of open pores on the surface in the middle of procedures of Example 7, to give an artificial leather.

The thus-obtained artificial leather had a fine and sharp image printed on the surface thereof. However, when the artificial leather was tested for light-resistant fastness, the color was partly discolored and changed and was far different from its original color, and it was evaluated as being grade 2. Further, the resistance thereof against color migration was also evaluated as being grade 3, and the color was transferred to a white artificial leather surface. Further, the tenacity thereof against peeling was as low as 11.5 N/cm, and a peeling site was in the pigment layer formed by the inkjet printing, and the artificial leather was not any product having durability against various uses as artificial leather. Further, the data for abrasion resistance thereof was 32 times because of the peeling of the pigment layer. Table 2 shows physical properties together.

Example 11

Leather-Like Sheet-11

(Formation of Protective Layer)

The printed surface of the leather-like sheet-2 obtained in Example 2 was gravure-coated with a basis weight of 60 g/m$^2$ of a solution prepared by mixing 100 parts of RESAMINE LU-2109HV (polyurethane supplied by Dainichiseika Color & Chemicals Mfg. Co., Ltd., concentration 22%), 15 parts of DMF and 15 parts of isopropyl alcohol, and a formed coating was dried at a temperature of 120° C. for 2 minutes to form a protective layer (elastic polymer layer), whereby a leather-like sheet (artificial leather)-11 was obtained.

The thus-obtained leather-like sheet-11 had a fine and sharp image printed on the surface thereof. When the surface was tested for light-resistant fastness, it was free of any change and it was evaluated as being grade 5 and was excellent. Further, the surface did not cause any color migration, and it was evaluated as being grade 5 and was excellent in resistance to color migration. The tenacity of the printed leather-like sheet-11 against peeling was 31.8 N/cm, and when the tenacity against peeling was measured, a peeling site was an interface between the nonwoven fabric layer and the polyurethane porous layer before the inkjet printing. Further, the data for abrasion resistance thereof was 680 times. Table 2 shows the physical properties thereof together.

Example 12

Leather-Like Sheet-12

(Formation of Protective Layer)

A release paper (ES160SK, supplied by LINTEC Corporation) was coated with a basis weight of 100 g/m$^2$ of a solution prepared by mixing 100 parts of RESAMINE LU-2109HV (polyurethane supplied by Dainichiseika Color & Chemicals Mfg. Co., Ltd., concentration 22% ), 20 parts of DMF and 10 parts of isopropyl alcohol, and a formed coating was dried at a temperature of 120° C. for 2 minutes to form a film of a high-molecular-weight. The surface of the film was further coated with a basis weight of 200 g/m$^2$ of an adhesive composition liquid prepared by mixing 20 parts of TA265 (polyurethane supplied by DIC Corporation (Dainippon Ink & Chemicals, Inc.), concentration 65%), 80 parts of TA290 (polyurethane supplied by DIC Corporation (Dainippon Ink & Chemicals, Inc., concentration 41%), 12 parts of an NE crosslinking agent (crosslinking agent supplied by Dainichiseika Color & Chemicals Mfg. Co., Ltd.) and 20 parts of DMF. Then, the formed coating was dried at a temperature of 120° C. for 2 minutes.

(Lamination)

Then, the elastic polymer on the release paper and the leather-like sheet-2 obtained in Example 2 were attached to each other and the resultant laminate was press-bonded by passing it through a gap of 0.8 mm between rolls. Then, the bonded laminate was left in an atmosphere at a temperature of 60° C. for 2 days and then the release paper was peeled off to give a leather-like sheet (artificial leather)-12. The thus-obtained leather-like sheet-12 had a fine and sharp image printed on the surface thereof. The leather-like sheet-12 was excellent in light-resistant fastness and resistance to color migration. The tenacity thereof against peeling was 34.5 N/cm, and when the tenacity against peeling was measured, a peeling site was an interface between the nonwoven fabric layer and the polyurethane porous layer before the inkjet printing. Further, the data for abrasion resistance thereof was 1,430 times. Table 2 shows the physical properties thereof together.

TABLE 2

| | Ex. 7 | Ex. 8 | Ex. 9 | Ex. 11 | Ex. 12 | C. Ex. 2 |
|---|---|---|---|---|---|---|
| Fiber aggregate No. | 7 | 7 | 7 | 1 | 1 | 7 |
| Fineness of fibers dtex | 0.03 | 0.03 | 0.03 | 0.15 | 0.15 | 0.03 |
| Elastic polymer layer | Yes | Yes | Yes | Yes | Yes | Yes |
| Method of forming pores | Application of solvent | Application of solvent | Application of solvent | Mechanical grinding | Mechanical grinding | No open pores |
| Maximum diameter μm | 40 | 40 | 40 | 110 | 110 | — |
| Average diameter μm | 15 | 15 | 15 | 55 | 55 | — |
| Density pieces/cm$^2$ | 1800 | 1800 | 1800 | Numerous | Numerous | — |
| Coloring inks | Organic-solvent-based pigment inks | Water-base pigment inks | UV-curable pigment inks | Organic-solvent-based pigment inks | Organic-solvent-based pigment inks | Dye inks |
| Surface finish (Protective layer) | No | No | Water-base laminate | Solvent-base gravure-coating | Solvent-based laminate | No |
| Tenacity against peeling N/cm | 36.2 | 30.5 | 34.7 | 31.8 | 34.5 | 11.5 |
| Abrasion resistance, times | 440 | 390 | 1360 | 680 | 1430 | 32 |
| Flexibility, times | 11000 | 11000 | 11500 | 12000 | 12000 | 11500 |
| Light-resistant fastness, grade | 5 | 5 | 5 | 5 | 5 | 2 |
| Resistance to color migration, grade | 5 | 5 | 5 | 5 | 5 | 3 |

Ex.: Example C. Ex.: Comparative Example

EFFECT OF THE INVENTION

The leather-like sheet of this invention can be leather-like sheet having a fine pattern printed thereon. Being excellent in abrasion resistance, light-resistant fastness, resistance to color migration, abrasion resistance, peel resistance and flexibility, the leather-like sheet of this invention can be good for various uses of artificial leather.

With regard to the image of the leather-like sheet of this invention, a pattern such as a decorative design, a mark, a picture, or the like can be easily expressed as a design on the leather-like sheet surface as required with a computer, etc., connected to an inkjet printer. Therefore, the leather-like sheet of this invention can bring an individuality-emphasizing "distinct pattern" into play in the fields of sport shoes, general shoes, balls for various games, bookbinding, clothing materials, furnishings and automobiles to which conventional leather-like sheets have been applied.

INDUSTRIAL UTILITY

The leather-like sheet of this invention can be used in the fields of sport shoes, general shoes, balls for various games, bookbinding, clothing materials, furnishings and automobiles.

The invention claimed is:

1. A process for the production of a leather sheet, which comprises the steps of:

(i) forming a porous layer of an elastic polymer (1) on a fibrous substrate, wherein (i-a) the porous layer is formed by applying a solution of the elastic polymer (1) in an organic solvent onto the substrate and then removing the solvent by a dry method or a wet method, or (i-b) the porous layer is formed by applying a solution of the elastic polymer (1) containing thermally expandable capsules or inert gas onto the substrate, (ii) removing a surface layer of the porous layer by applying a solvent onto the surface of the porous layer, to form open pores in the range of 100 to 3,000 per $cm^2$ on the surface, and (iii) forming an image comprising a pigment ink on the porous layer surface provided with the open pores, by an inkjet printing method.

2. The process of claim 1, wherein the fibrous substrate is a nonwoven fabric or a composite nonwoven fabric prepared by impregnating a nonwoven fabric with an elastic polymer (2).

3. The process of claim 1, wherein the elastic polymer (1) is a polyurethane.

4. The process of claim 1, wherein the step (i) of forming the porous layer comprises the steps of:

(i-1) applying a solution containing the elastic polymer (1) and an organic solvent onto the fibrous substrate, and (i-2) immersing an obtained laminate in water to coagulate the elastic polymer.

* * * * *